US006106064A

United States Patent [19]

Hibberd

[11] Patent Number: 6,106,064

[45] **Date of Patent: *Aug. 22, 2000**

[54] SWIVELLING AND TILTING CHAIR

[75] Inventor: Ronald Charles Hibberd, Grays Point, Australia

[73] Assignee: Claiteal Pty. Ltd., Sydney, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/091,112

[22] PCT Filed: Jan. 21, 1997

[86] PCT No.: PCT/AU97/00034

§ 371 Date: Jun. 12, 1998

§ 102(e) Date: Jun. 12, 1998

[87] PCT Pub. No.: WO97/27785

PCT Pub. Date: Aug. 7, 1997

[30] Foreign Application Priority Data

Jan. 30, 1996 [AU] Australia ..... PN7799

[51] Int. Cl.[7] ..... A47C 1/00

[52] U.S. Cl. ..... 297/314; 297/313

[58] Field of Search ..... 297/314, 313, 297/461, 302.4; 248/133

[56] References Cited

U.S. PATENT DOCUMENTS

| | | | |
|---|---|---|---|
| Re. 8,389 | 8/1878 | Whitcomb | 297/314 |
| 567,320 | 9/1896 | Milner | 297/333 X |
| 621,140 | 3/1899 | Reuter | 297/314 X |
| 1,070,278 | 8/1913 | McKinney | 297/314 X |
| 2,132,291 | 10/1938 | Fitos | 297/314 X |
| 2,787,315 | 4/1957 | Siebert | 297/313 X |
| 4,183,494 | 1/1980 | Cleveland . | |
| 4,372,606 | 2/1983 | Faull . | |
| 5,524,967 | 6/1996 | Glockl . | |
| 5,570,829 | 11/1996 | Harrison . | |

FOREIGN PATENT DOCUMENTS

| | | | |
|---|---|---|---|
| 0161062 | 11/1985 | European Pat. Off. . | |
| 783530 | 4/1935 | France | 297/405 |
| 190229 | 10/1907 | Germany | 297/314 |
| 287619 | 9/1915 | Germany | 297/314 |
| 361693 | 3/1921 | Germany | 297/405 |
| 2642112 | 3/1978 | Germany | 297/313 |
| 3530030 | 4/1986 | Germany . | |
| 3612201 | 10/1987 | Germany | 297/313 |
| 314785 | 10/1929 | United Kingdom . | |
| 2167947 | 6/1986 | United Kingdom . | |
| 9516374 | 6/1995 | WIPO . | |
| 9624273 | 8/1996 | WIPO . | |

*Primary Examiner*—Peter R. Brown
*Assistant Examiner*—David E. Allred
*Attorney, Agent, or Firm*—Edwin D. Schindler

[57] ABSTRACT

A chair (1) including a seat (2) coupled to a mounting shaft (3) having an axis of rotation (7), a base (4) and a shaft coupling which allows the shaft (3) to swivel relative to the base (4) about the axis of rotation (7) and allows the shaft (3) to tilt relative to a vertical orientation of the chair (1) to various degrees in the seat (4) direction and sideward directions and prevents the shaft (3) tilting to any substantial extent in the seats (2) rearward direction. The shaft coupling includes a spring bearing allowing the rotation and tilting and includes a cam fitted on the shaft (3) which limits the degree of tilting in accordance with the shape of the cam.

9 Claims, 3 Drawing Sheets

SWIVELLING AND TILTING CHAIR

BACKGROUND OF THE INVENTION

In some environments the movement of a seated occupant includes a reaching movement while remaining seated, such as a seated worker on a production line.

Some chairs are provided with a swivel action which may only partly assist the seated occupant in the reaching movement while other chairs may be provided with castors which allow movement of the whole chair which may be cumbersome in some situations.

If the reaching movement is repetitive or frequent, these two degrees of freedom of movement may not be appropriate for some seated occupants leading to uncomfortable reaching movements, accompanied by a bad sitting posture during the movement, which may lead to problems with the back.

SUMMARY OF THE INVENTION

The invention provides a chair including a seat, a mounting shaft, a shaft coupling, and a base, wherein the mounting shaft is coupled to the base so the mounting shaft may swivel and may tilt to various degrees in a forward and sideward direction and is prevented from tilting in a rearward direction to any substantial extent.

A preferred embodiment of the invention provides a chair that includes a seat fixed to a mounting shaft that is coupled to a base by means of a slewing coupling. The coupling is configured to allow tilting of the seat and mounting shaft relative to the base from a substantially vertical axis. Preferably the coupling is configured to prevent the seated occupant tilting the seat in a rearward direction in relation to the seated occupant, and the coupling includes a cam which defines the range and pattern of tilt. Additionally the coupling may be configured to allow swivelling of the seat and mounting shaft.

The mounting shaft also may be biased to a substantially vertical position by a resilient means such as a spring, to assist the seated occupant to maintain an upright seated position, and to assist in the return of the seat to an upright position at the end of a reaching movement by the seated occupant.

BRIEF DESCRIPTION OF THE DRAWINGS

The invention will now be described by way of example with reference to an embodiment illustrated in the accompanying drawings, in which.

DESCRIPTION OF THE PREFERRED EMBODIMENTS

Figure 1:
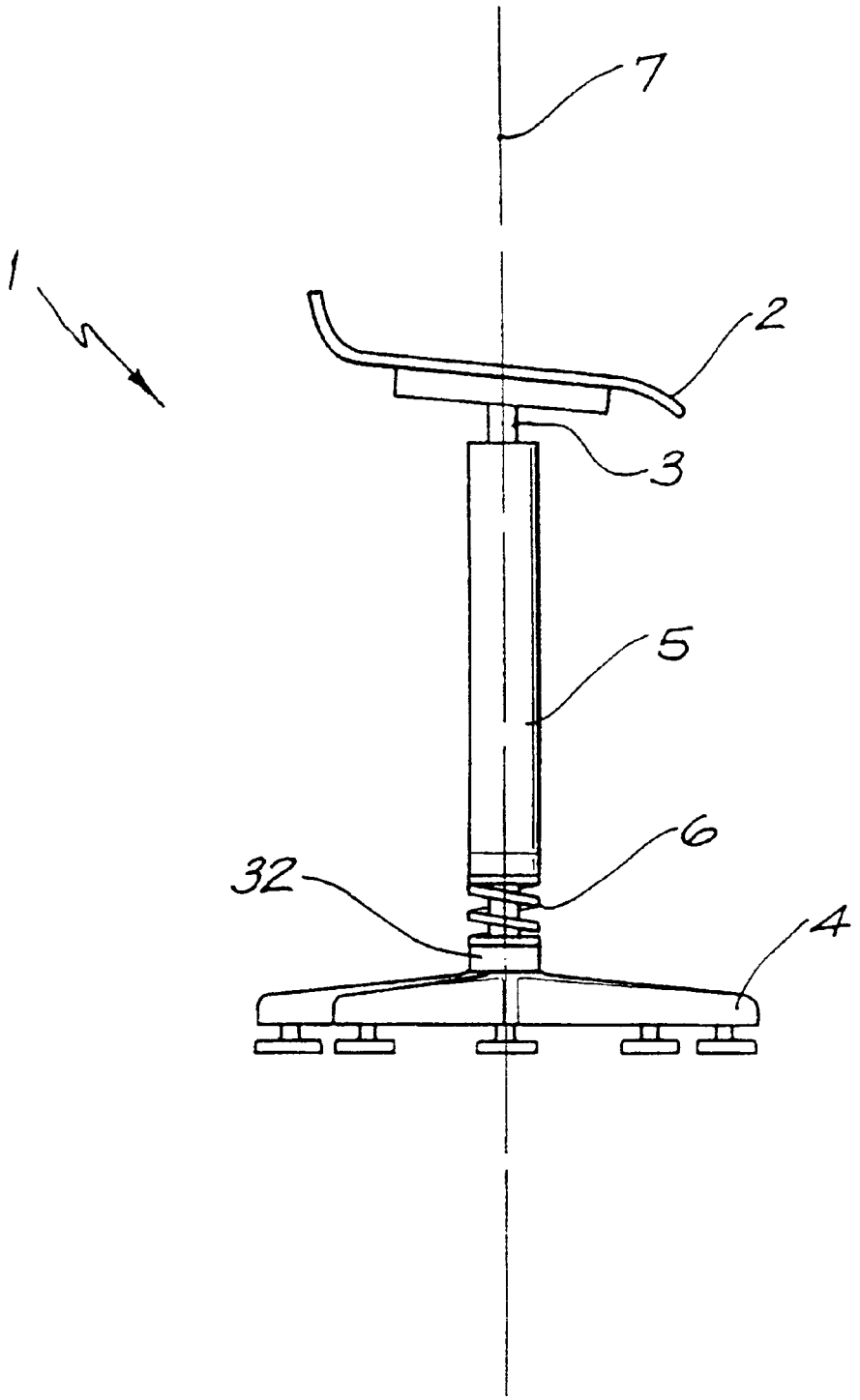
FIG. 1 is an illustration of a chair embodying the invention biased in an upright position.
Figure 2:
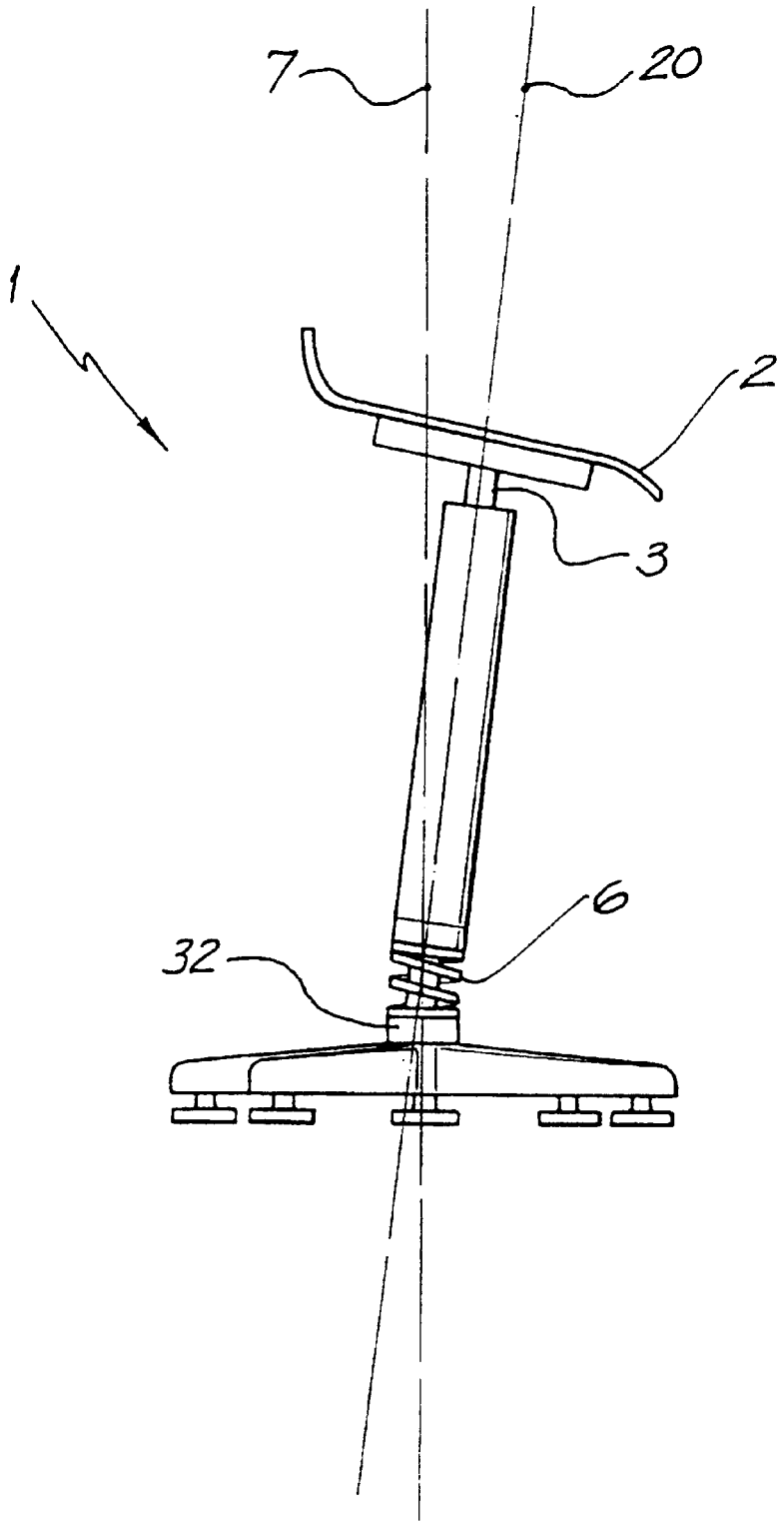
FIG. 2 is an illustration of a chair embodying the invention in a tilted position.
Figure 3A:
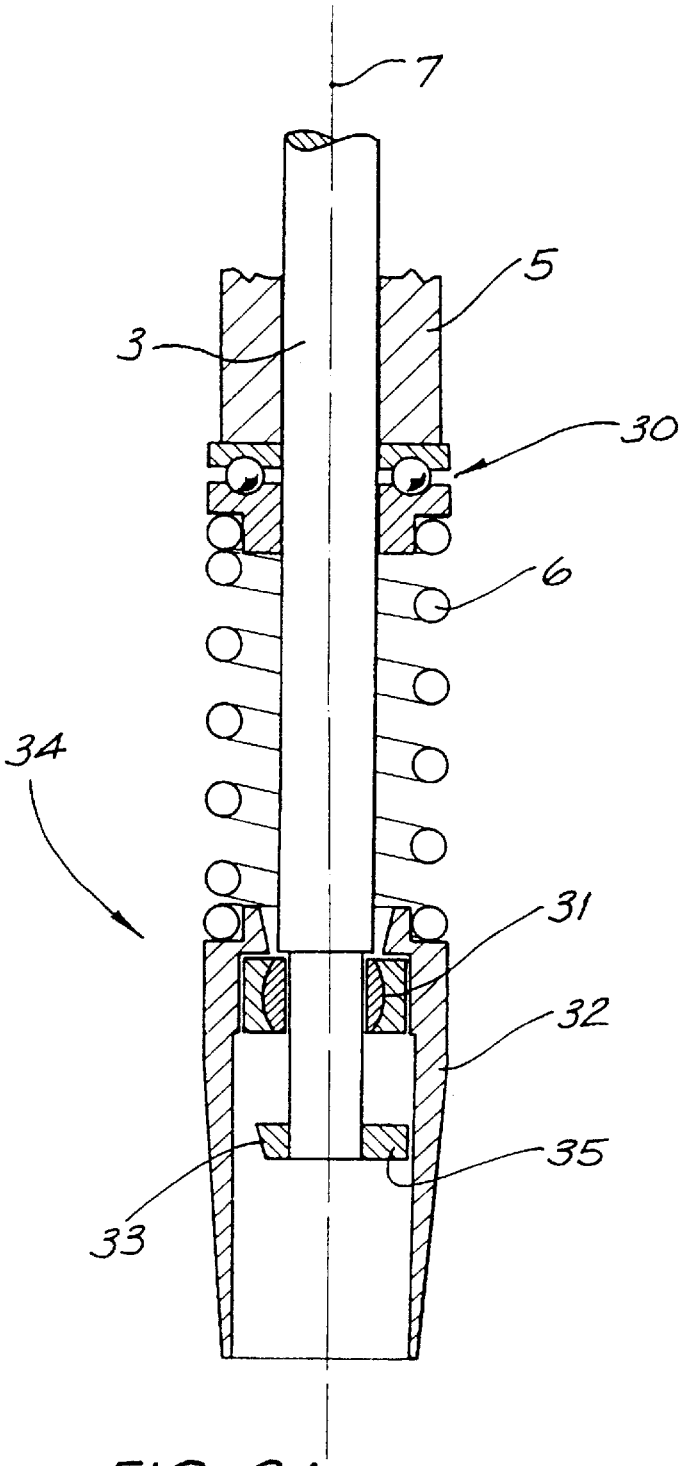
FIG. 3A is a part cross sectional view of a coupling suitable for coupling the mounting shaft and base of the chair depicted in FIG. 1.
Figure 3B:
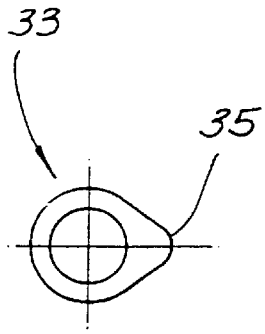
FIG. 3B is a plan view of a cam suitable for use in the coupling depicted in FIG. 3A.

The chair 1 in FIGS. 1 and 2 includes a seat 2 fixed to a mounting shaft 3 which is enveloped by a shaft column 5 and coupled to a base fitting 32 on a base 4 by means of a coupling 34 illustrated in FIGS. 3A and 3B. The shaft column 5 is fixed to the mounting shaft 3 to prevent the shaft column 5 rotating relative to the mounting shaft 3.

The chair 1 is provided with a coil spring 6 which biases the seat 2 and mounting shaft 3 to an upright position as illustrated in FIG. 1 and depicted by a vertical axis 7. The seat 2 and mounting shaft 3 may be tilted relative to the vertical axis 7 as illustrated by a tilted axis 20 in FIG. 2, against the bias exerted by the coil spring 6. If the tilting force exerted by a seated occupant (not shown) is removed, then the seat 2 and the mounting shaft 3 will return to an upright position depicted by the vertical axis 7 in FIGS. 1 and 2.

The coupling 34 in FIG. 3A couples the mounting shaft 3 to the base fitting 32 by means of a rod end bearing 31 allowing rotation and slewing of the mounting shaft 3 relative to the base fitting 32. The degree and pattern of slewing of the mounting shaft 3 relative to the base fitting 32 is predetermined by a cam 33 fixed to the mounting shaft 3.

The coil spring 6 is engaged with the base fitting 32 and a thrust race 30 fitted to the shaft column 5. The thrust race 30 provides bearing assisted rotation of the shaft 3 relative to the base fitting 32.

The illustrated cam 33 will prevent a seated occupant (not shown) on the chair 1 tilting the seat 2 to a substantial extent in a rearward direction. For this purpose the lobe portion of the cam surface 35 is orientated towards the front of the seat 2, so that upon rearward tilting of the chair it will contact an inner surface of the base fitting 32 thereby restricting or prohibiting rearward titling of the seat 2 and the mounting shaft 3. On the other hand, the remaining surface of the cam 33 will allow more extensive forward and sideways tilting or combined forward and sideways tilting.

Therefore in use a chair in accordance with the invention may tilt within predetermined limits and pattern, while being free to swivel thereby assisting a seated occupant during a reaching movement.

In a further contribution to the ergonomics of the chair in its preferred form, the seat 2 is tilted forwardly to throw more of the seated occupant's weight onto the seated occupant's feet than would occur if the seat was substantially horizontal. The seated occupant's feet will thus form a tripod with the chair, providing a stable base for the seated occupant's sitting position and reaching movements.

It is to be understood that the invention has been described with reference to an embodiment only for the purpose of illustration and is not intended to be confined to that embodiment.

What is claimed is:

1. A chair, comprising:

a base having feet for supporting said chair in an upright position;

a seat;

a mounting shaft to which said seat is coupled, said mounting shaft having a longitudinal axis of rotation;

a hollow shaft column for accommodating said mounting shaft and fixed to said mounting shaft against relative rotation thereof, one end of said mounting shaft extending beyond a free end of said hollow shaft column proximal said base;

a shaft coupling for coupling said mounting shaft to said base, said shaft coupling including means for allowing said mounting shaft to swivel relative to said base about said axis of rotation, said shaft coupling further including means for allowing said mounting shaft to tilt relative to a vertical orientation of said chair to a predetermined degree in a forward direction and sideward directions of said seat, and including means for substantially preventing said mounting shaft from tilting in a rearward direction of said seat; and, resilient means biasing said mounting shaft away from and into a substantially vertical orientation with respect to said base, said resilient means extending about said one end of said mounting shaft and extending between said base and said hollow shaft column.

2. The chair according to claim 1, wherein said resilient means is a coil spring enveloping at least a portion of said mounting shaft.

3. The chair according to claim 1, wherein said means for substantially preventing said mounting shaft from tilting in a rearward direction of said seat includes stop means on said mounting shaft abutting said base when said mounting shaft is tilted in said rearward direction, and said means for allowing said mounting shaft to swivel and said means for allowing said mounting shaft to tilt operate by including a slewing bearing fitted between said mounting shaft and said base.

4. The chair according to claim 3, wherein said resilient means is a coil spring enveloping at least a portion of said mounting shaft.

5. The chair according to claim 3, wherein said stop means on said mounting shaft includes a cam fitting to said mounting shaft defining an allowable pattern of tilting in accordance with a given shape of said cam.

6. The chair according to claim 5, wherein said resilient means is a coil spring enveloping at least a portion of said mounting shaft.

7. The chair according to claim 5, wherein said seat is tilted forwardly with respect to said mounting shaft.

8. The chair according to claim 7, further comprising bearing means on said free end of said hollow shaft column, and wherein said resilient means extends between said base and said bearing means.

9. The chair according to claim 8, wherein said bearing means is a thrust bearing.

* * * * *